US005417133A

United States Patent [19]

Bakermans et al.

[11] Patent Number: 5,417,133

[45] Date of Patent: May 23, 1995

[54] SCRAP HANDLING IN A BLANKING DIE

[75] Inventors: Johannes C. W. Bakermans, Harrisburg; Lawrence R. Holbrook, Jonestown; Brian J. Stumm, Harrisburg, all of Pa.

[73] Assignee: The Whitaker Corporation, Wilmington, Del.

[21] Appl. No.: 200,096

[22] Filed: Feb. 22, 1994

[51] Int. Cl.[6] ..... B26F 1/14

[52] U.S. Cl. ..... 83/146; 83/166; 83/690

[58] Field of Search ..... 83/93, 97, 111, 145, 83/146, 149, 163, 164, 166, 685, 690, 112

[56] References Cited

U.S. PATENT DOCUMENTS

| | | | |
|---|---|---|---|
| 1,631,323 | 6/1927 | Loesel | 83/146 |
| 3,358,538 | 12/1967 | Maceyka | 83/166 X |
| 4,819,476 | 4/1989 | Bakermans et al. | 72/456 |
| 4,974,479 | 12/1990 | Bakermans et al. | 83/145 |
| 5,136,907 | 8/1992 | Bakermans et al. | 83/93 |

FOREIGN PATENT DOCUMENTS

| | | | |
|---|---|---|---|
| 59-110431 | 6/1984 | Japan | 83/146 |
| 60-92024 | 5/1985 | Japan | 83/146 |

*Primary Examiner*—Richard K. Seidel
*Assistant Examiner*—Raymond D. Woods

[57] ABSTRACT

A stamping and forming machine positively prevents slug pulling by stripping the slug off of the end of the punch as the punch is being withdrawn from the die opening after a blanking operation. This is accomplished by providing a die insert support in supporting contact with the die insert having an opening that is identical to the opening in the die insert, but that is rotationally or laterally displaced therefrom by a small amount. As the punch pushes a slug through the opening in the die insert, the slug encounters the displaced opening in the die insert support and is shifted slightly as it is forced into that opening by the punch. As the punch is withdrawn from the die insert opening, the shifted slug cannot return through the opening and is stripped off of the end of the punch.

24 Claims, 6 Drawing Sheets

SCRAP HANDLING IN A BLANKING DIE

The present invention relates to blanking dies and the handling of scrap from the blanking operation, and in particular to the prevention of slug pulling by the punch.

BACKGROUND OF THE INVENTION

Blanking dies are used to cut openings in sheet stock, the workpiece, in the manufacture of various products. Typically, these blanking dies consist of a punch and mating die which are arranged to engage the workpiece to cut the opening and then to disengage so that the workpiece can be advanced to the next station for additional operations. As the punch approaches the die it engages the surface of the workpiece, pushing it against the die opening and forcing a slug of the material through the opening and into an area where the scrap slugs are collected and removed from the tooling. Occasionally, one of these scrap slugs sticks to the end of the punch, after blanking, and is pulled out of the die opening. This is known as "slug pulling" in the industry. This loose slug then may catch on the edge of the freshly cut opening in the workpiece and result in a misfeed of the workpiece or it may remain on the end of the punch and interfere with the next blanking operation. This can cause serious damage to the tooling or the press. In any case, this results in a damaged product that must be identified and discarded. This can be extremely difficult to do when high speed stamping multi-out, progressive tooling modules that are producing thousands of products per minute are involved. It is very desirable to prevent the slug pulling in the first place. In conventional punch press applications where a reciprocating punch is arranged vertically above a fixed die, a vacuum system is most frequently used to augment the effect of gravity to pull the slugs downwardly away from the punch and into an exit cavity within the die tooling. However, this is not always an effective solution. In a horizontally arranged punch and die tooling module, however, the effects of gravity are not helpful and, if the stock being blanked is thin, the slugs will have very little mass and tend to adhere to the end of the punch more readily, especially if a thin film of lubricating oil is present on the surface of the stock. Of the attempts to control the removal of scrap and prevent slug pulling in this case, the most prominent include either a spring loaded member that is urged against the stack of slugs, as disclosed in U.S. Pat. No. 4,974,479 which issued Dec. 4, 1990 to Bakermans et al., or a protrusion in the slug exit opening that interferes with the slug thereby holding it within the opening. The later structure is disclosed in U.S. Pat. No. 5,136,907 which issued Aug. 11, 1992 to Bakermans et al. and which is incorporated herein by reference. The '907 patent discloses a punch and die arrangement wherein a camming rib is provided along one of the interior walls of the die opening that extends into the opening a small amount. There must be a small amount of additional clearance, than would otherwise be necessary, between the punch and the walls of the die opening so that as the punch enters the die opening it does not interfere with the camming rib. The bottom surface of the slug, however, is the same size as the die opening and, therefore, will interfere with the camming rib which tends to hold the slug in the die opening when the punch is withdrawn, although, slug pulling is not positively prevented.

What is needed is a mechanism that positively prevents slug pulling while maintaining normal clearances between the punch and mating die opening and, without the need for complex spring loaded members for holding the slug within the die opening.

SUMMARY OF THE INVENTION

A punch and mating die assembly is disclosed, the punch or the die being arranged to reciprocate toward and away from the other for blanking an opening of desired shape in a workpiece positioned therebetween. The assembly includes a punch having an outer mating surface of desired shape and a die insert having a first opening of the desired shape in alignment with the punch for mating therewith. The first opening is sized to receive the punch therein with a predetermined amount of clearance between all opposing surfaces. A die insert support is arranged in abutting support against a side of the die insert opposite the punch for supporting the die insert during the blanking operation. The die insert support has a second opening substantially identical to the first opening and positioned slightly out of alignment therewith. The assembly is arranged so that when the punch or die reciprocate into engagement with the other, a slug is blanked out of the workpiece and moved through the first opening and forced out of alignment with the first opening and into the second opening.

DESCRIPTION OF THE PREFERRED EMBODIMENT

Figure 1:
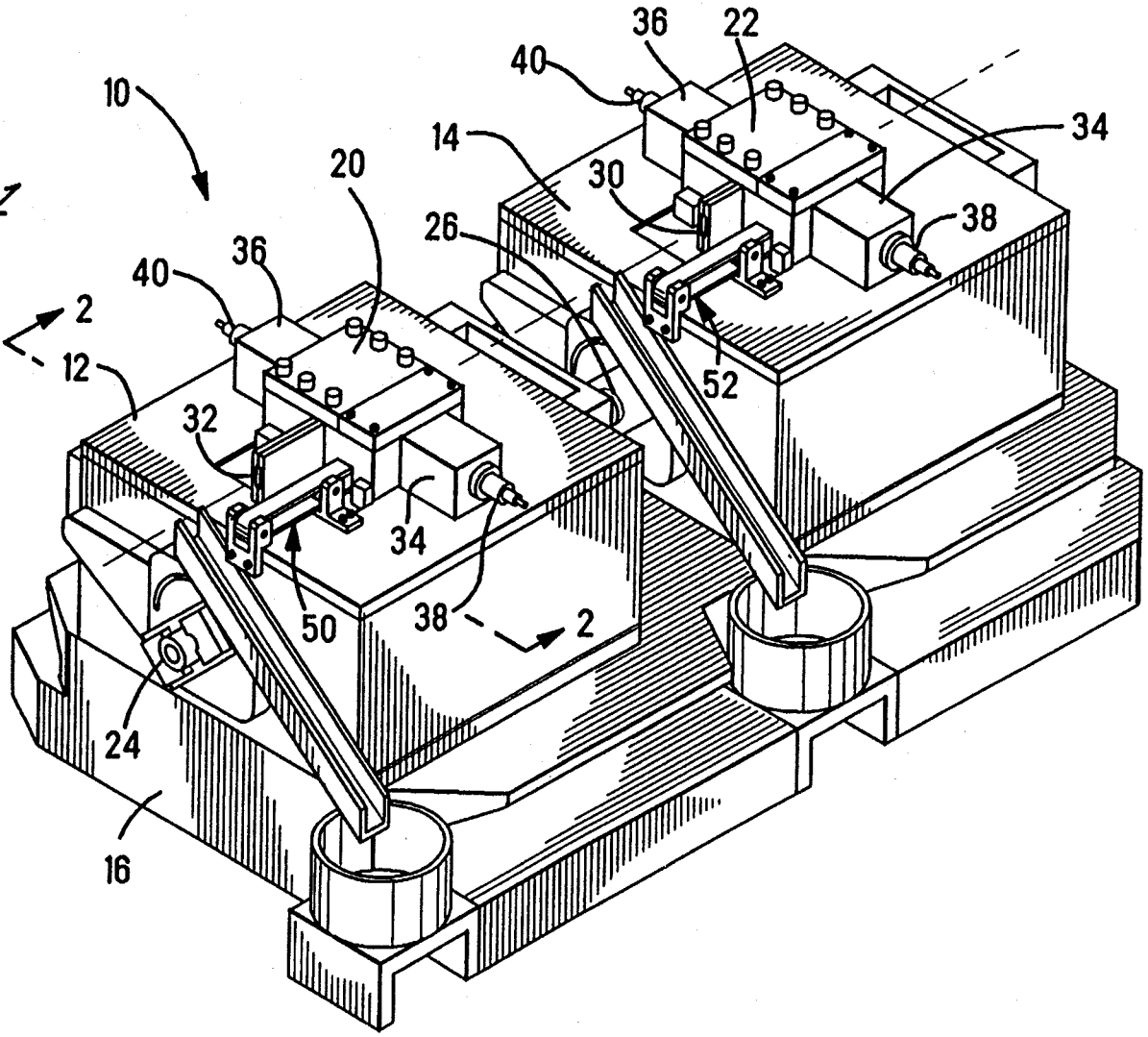
FIG. 1 is an isometric view of a two module stamping and forming machine incorporating the teachings of the present invention.
Figure 2:
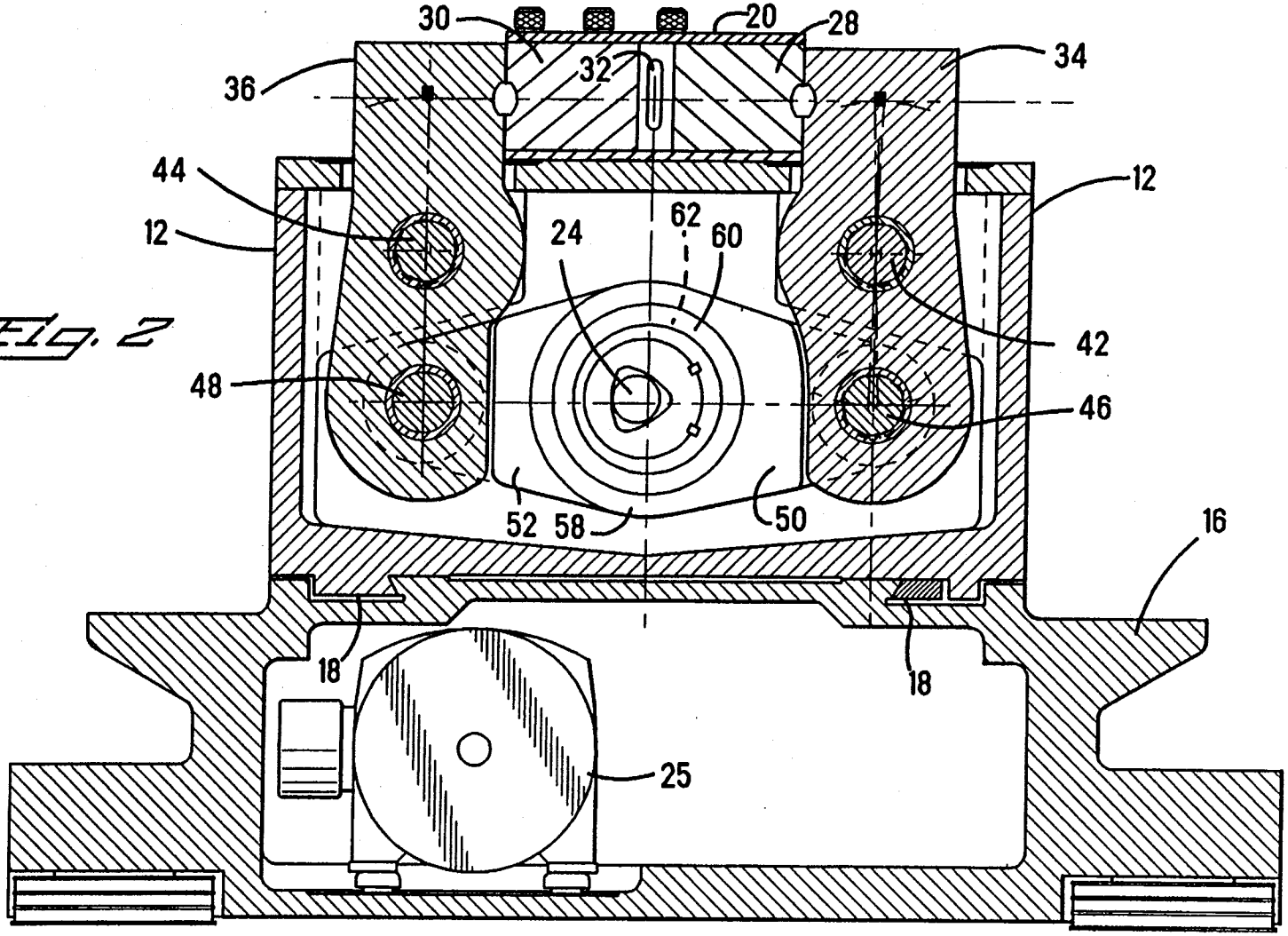
FIG. 2 is a partial cross-sectional view taken vertically through one of the modules shown in FIG. 1.

There is shown in FIGS. 1 and 2 a stamping and forming machine 10 having a first stamping and forming module 12 and a second stamping and forming module 14. FIG. 2 is a cross section of the entire machine 10 taken through the first module 12 approximately along the lines 2—2 in FIG. 1. The first and second modules, 12 and 14, are mounted to a machine base 16 and arranged in ways 18, as best seen in FIG. 2, so that their relative spacing can be adjusted when the machine is set up for a particular job. This means of adjustment is provided to assure that the tooling in the first module will be in proper alignment with respect to the tooling in the second module so that a strip having operations performed on it in the first module will be in proper alignment in the second module for further operations there. The modules 12 and 14 have first and second tooling assemblies 20 and 22, respectively, mounted to their top mounting plates, as shown in FIG. 1. Each module has a drive shaft 24 and an electric motor 25 for rotating the drive shaft during operation of the machine. The motor is coupled to the drive shaft 24 by means of a belt and pulley in the usual manner. The two drive shafts 24 are rotationally coupled together by a coupling assembly 26. Each tooling assembly 20 and 22 includes a pair of opposing ram assemblies 28 and 30 which contain tooling on their ends which mate to perform the stamping and forming operation on strip stock that is fed through aligned slots 32. The opposing ram assemblies of each module are arranged to reciprocate toward and away from each other along horizontal paths. The rams 28 and 30 are caused to reciprocate by means of first and second levers 34 and 36 which are coupled to their respective rams as shown at 38 and 40, in a manner well known in the art. Each lever 34, 36 is pivoted intermediate its ends at 42 and 44 and its lower end is pivoted at 46, 48 to the drive shaft 24 by means of a pair of eccentrically coupled links 50 and 52, respectively, so that rotation of the drive shaft 24 will cause the levers 34 and 36 to impart reciprocating motion to the rams 28 and 30.

Figure 3:
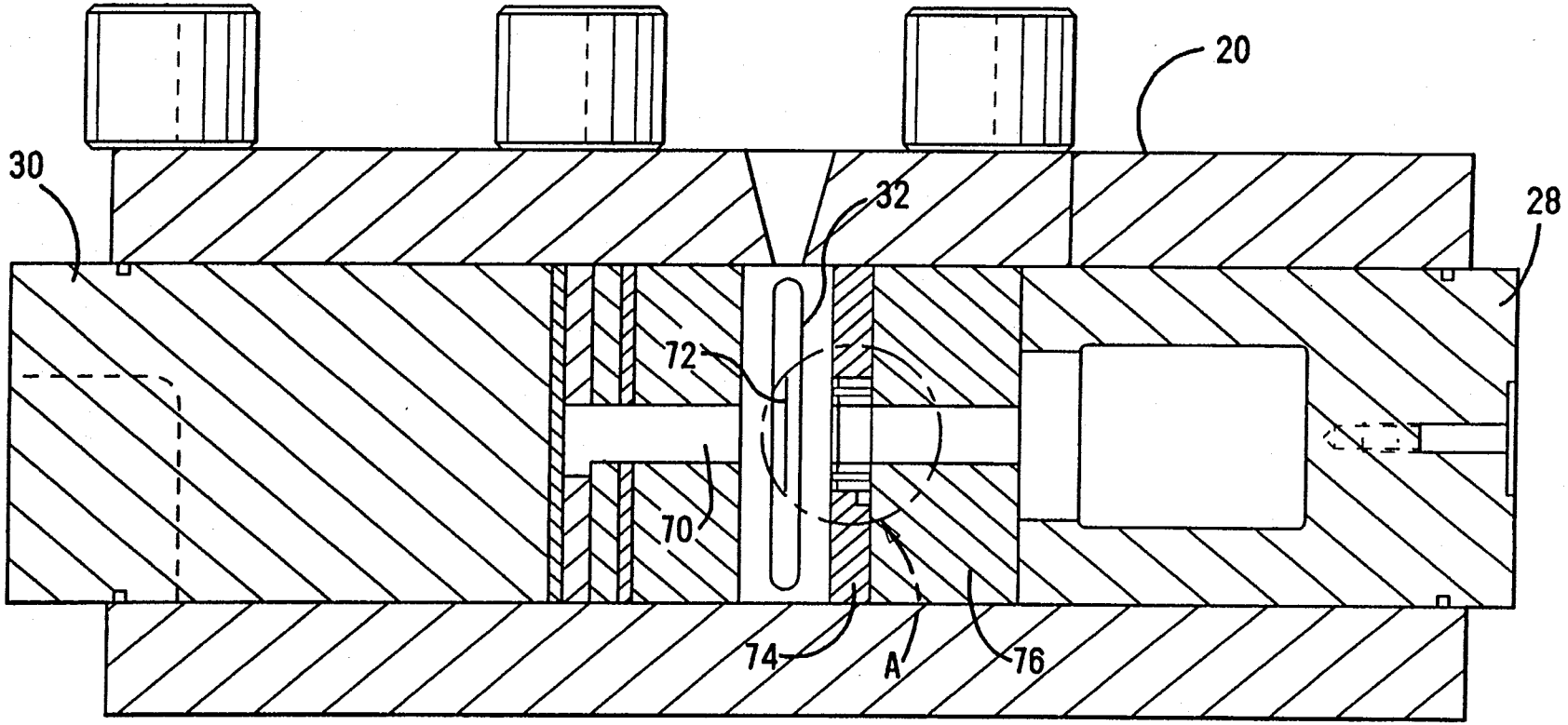
FIG. 3 is an enlarged view of the tooling module of FIG. 2.
Figure 5:
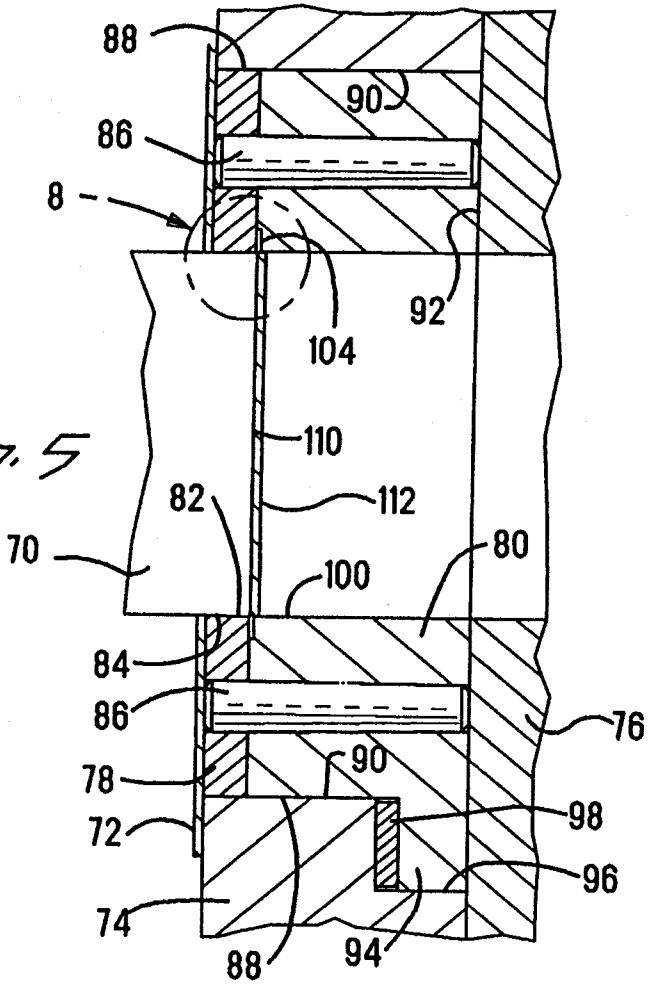
FIGS. 4 and 5 are enlarged partial views of the area indicated at A in FIG. 3 showing the punch in different positions during blanking.
Figure 4:
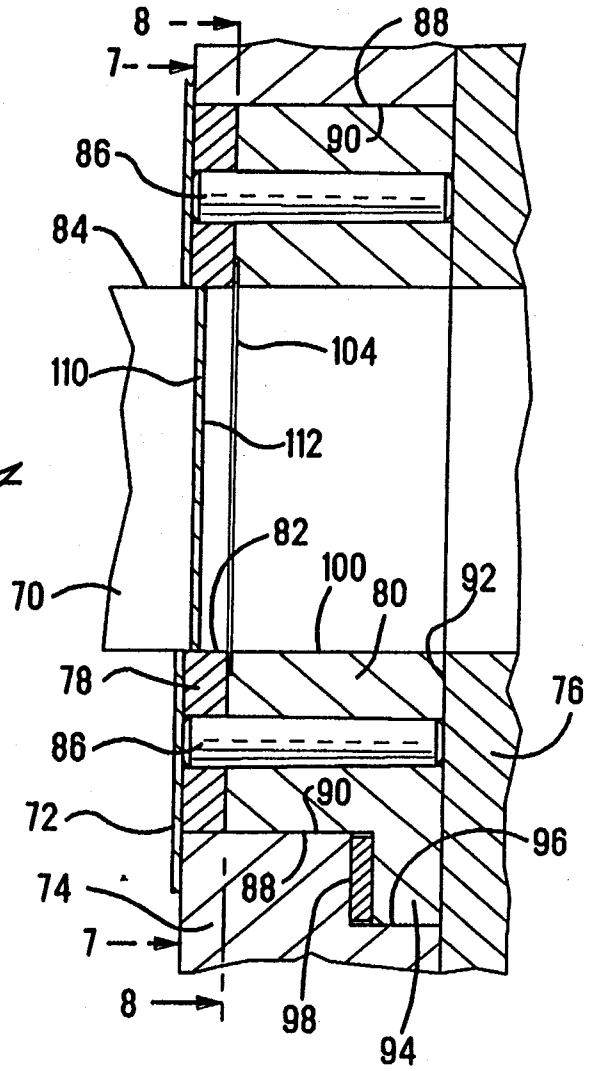
Figure 7:
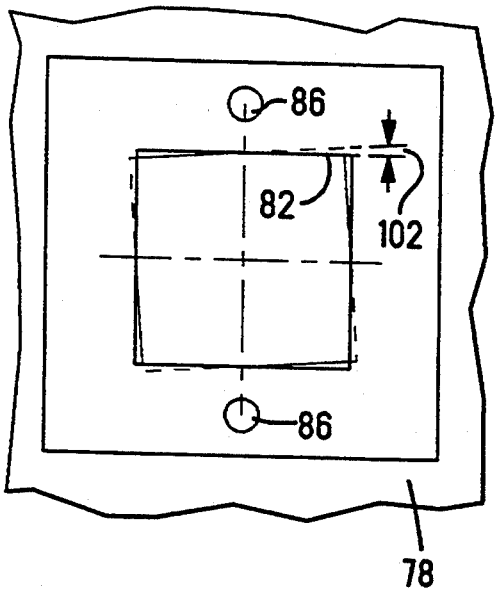
FIG. 7 is a cross-sectional view taken along the lines 7—7 in FIG. 4 showing a rectangular die opening with the punch removed for clarity.
Figure 8:
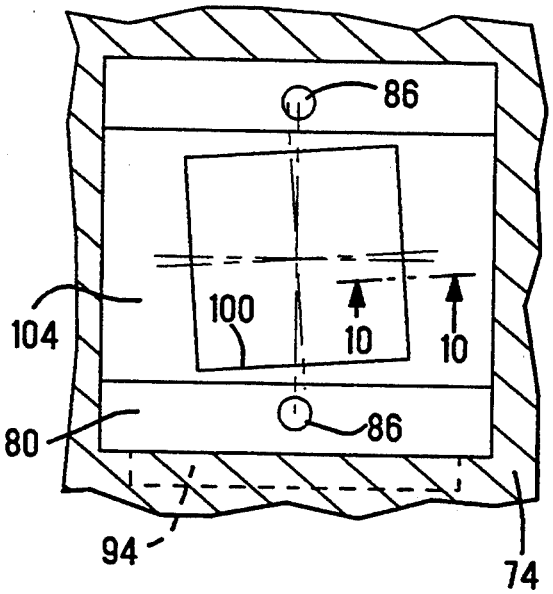
FIG. 8 is a cross-sectional view taken along the lines 8—8 in FIG. 4
Figure 10:
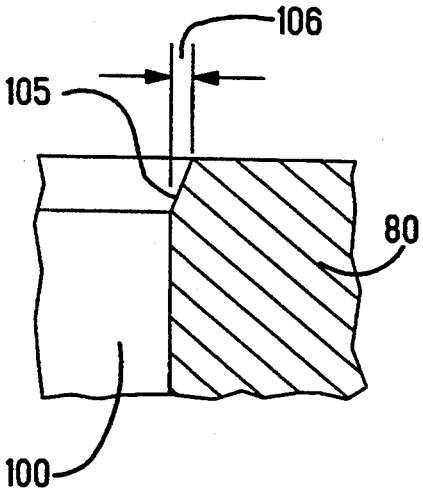
FIG. 10 is a cross-sectional view taken along the lines 10—10 in FIG. 8.

There is shown in FIG. 3 an enlarged view of the tooling module 20 shown in FIG. 2, with a simplified tooling arrangement to more clearly set forth the principles of the present invention. The rams reciprocate in a box structure that is fully described in U.S. Pat. No. 4,819,476 which issued Apr. 11, 1989 to Bakermans et al. and which is incorporated herein by reference. This simplified tooling arrangement includes a single punch 70 that is reciprocated by the ram 30 toward and away from a workpiece 72 that is cyclically advanced through the two tooling modules 20 and 22 within the slots 32 during operation of the machine. A mating die assembly including a die plate 74 and a die backup plate 76 is reciprocated by the ram 28 toward and away from the workpiece 72. As the punch 70 and die assembly reciprocate toward each other, they engage the workpiece and perform the desired blanking operation thereon, the workpiece is then advanced for the next stamping and forming operation. As best seen in FIGS. 4 and 5, the die assembly includes a die insert 78 and a die insert support 80. The die insert has an opening 82 that closely conforms to the shape of the peripheral edge of the punch 70, which is rectangular in the present example, but is made slightly larger to allow clearance for the sides 84 of the punch. This clearance, while it may vary depending on the material of the workpiece and the design of the tooling, in the present example, is on the order of about 6 percent of the thickness of the workpiece. This clearance is indicated as 85 in FIG. 6 and is shown exaggerated for clarity. In the present example the workpiece has a thickness of 0.014 inch and there is about 0.0008 clearance between the opening 82 and all of the sides 84 of the punch. The die insert 78 is attached to the die insert support 80 by means of a pair of taper pins 86 that are snugly inserted into mating tapered holes formed through the two parts in the usual manner. The larger end of each pin 86 is in the die insert 78 and the smaller end is in the die insert support 80 so that the die insert is firmly held against the die insert support. The outer surfaces 88 of the die insert 78 and support 80 assembly are rectangular, in the present example, and are a slip fit with an opening 90 in the die plate 74 which accurately locates the die insert with respect to the punch 70. The die plate 74 is attached to a surface 92 of the die backup plate 76 and the die insert support 80 abuts this surface 92 and transfers forces from the blanking operation to the die backup plate. The die insert support 80 includes a heel 94 projecting from one side thereof into an opening 96 formed in the bottom surface of the die plate 74. The opening 96 is deep enough to permit a shim 98 to be inserted between the heel 94 and the bottom of the opening 96, as shown in FIGS. 4 and 5. This permits sharpening of the die insert 78 which makes it thinner. The shim 98 is then made correspondingly thinner and a suitable shim is inserted between the die insert support and the surface 92 to bring the outer surface of the die insert out to its original position, flush with the die plate 74. As shown in FIGS. 4, 5, and 8, the die insert support 80 has an opening 100 that is identical in size and shape to the opening 82 in the die insert 78. The opening 100, in this example, is positioned coaxially with the opening 82 but is rotated counter clockwise out of alignment with the opening 82, as best seen in FIGS. 7 and 8. The amount of out of alignment, indicated by 102 in FIG. 7, is chosen to be about equal to the amount of clearance 85 or about 6 percent of the thickness of the workpiece. Note that, as seen in FIG. 7, the amount of out of alignment varies depending upon where it is measured. For purposes of this disclosure the amount of out of alignment indicated by 102 will be considered measured it the point of maximum out of alignment. An undercut 104 is formed in the surface of the die insert support 80 that abuts the die insert 78 for a purpose that will be explained below. The undercut 104 has a depth equal to about one half the thickness of the workpiece 72 and a width that extends beyond the sides of the opening 100 a small amount, as best seen in FIG. 8. As shown in FIG. 10, the walls of the opening 100 have a chamfer 105 at the bottom of the undercut 104 to provide a lead in 106 of about the same magnitude as the amount of out of alignment 102 shown in FIG. 7.

Figure 6:
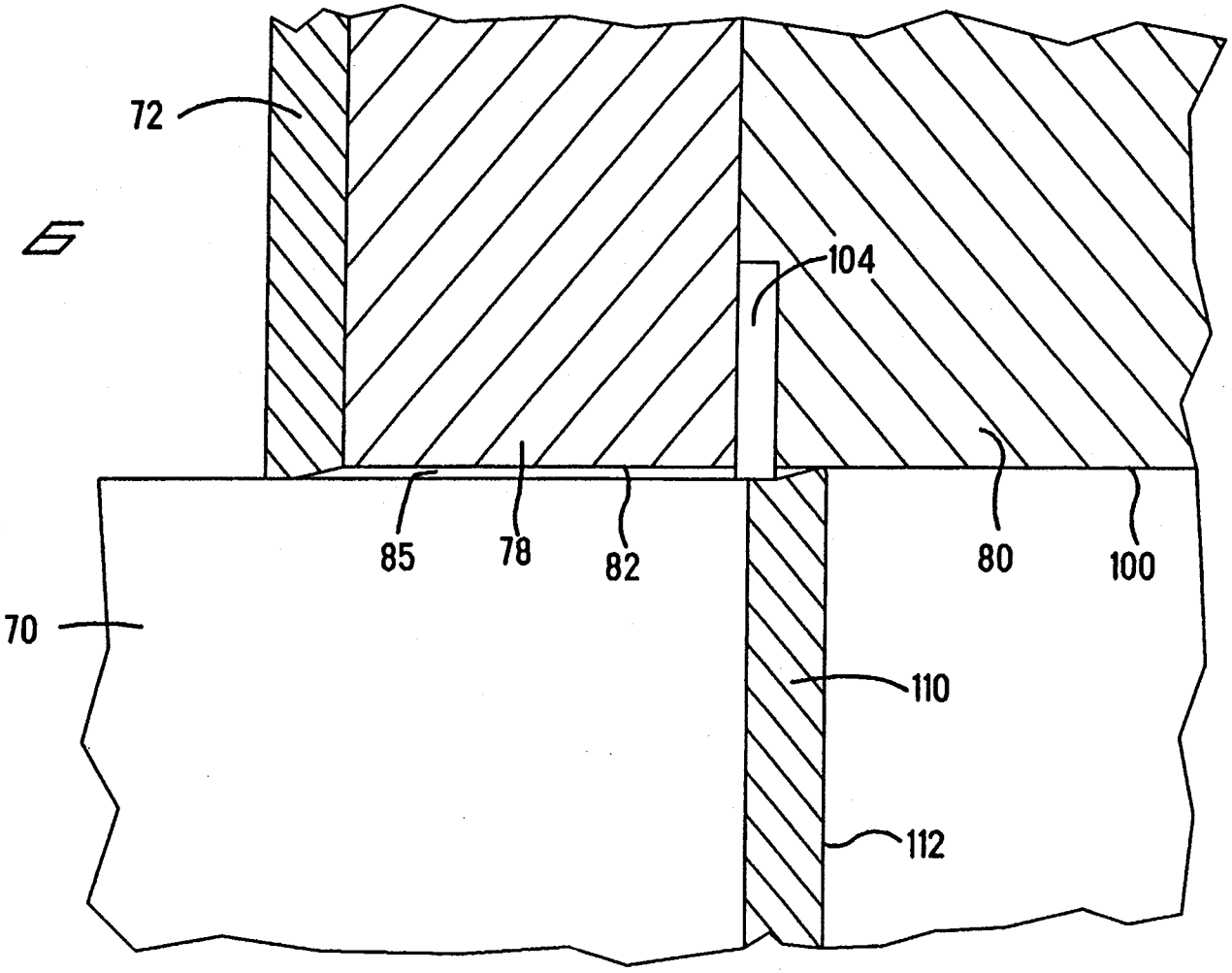
FIG. 6 is an enlarged partial view of the area indicated at 8 in FIG. 5.

In operation, as best seen in FIGS. 4, 5, and 6, the punch 70 and die assembly 74, 76,78, and 80 are reciprocated toward each other, with the punch blanking a slug 110 out of the workpiece 72, as shown in FIG. 4, and pushing it into the opening 82 toward the die insert support 80. As motion continues, the punch 70 advances the bottom surface 112 of the slug 110 into the undercut 104 and into engagement with the top edge of the opening 100. As will be noted in FIG. 6, when the slug 110 is first blanked out of the workpiece 72 the peripheral edge that is away from the punch is slightly larger than is the peripheral edge that is against the punch by an amount that is close to the clearance 85. As this larger peripheral edge engages the chamfer 105 the slug is forced to rotate slightly to enter the opening 100. This rotation causes the slug 110 to rotate in the opening 82 as well, however, since the amount of out of alignment 102, as shown in FIG. 7, is about equal to the clearance 85 between the punch 70 and die insert opening 82, there will be little or no interference. Relative motion between the punch and die assembly continues until the bottom of the punch 70 enters the undercut 104, as shown in FIG. 5, and the slug 110 has passed the chamfer 105 and engaged the straight walls of the opening 100. At this point the relative direction of motion of the punch and die assembly is reversed and the punch 70 is withdrawn from the opening 82. The slug 110, however is prevented from following the punch because it is rotated out of alignment with the opening 82 and is therefore trapped below the die insert. The slug 110 is simply striped off of the end of the punch 70 when the punch withdraws into the opening 82. The surface tension of any oil film the may be between the slug 110 and the end of the punch 70 is weakened somewhat by the rotation of the slug thereby further aiding separation. The undercut 104 has a depth that is substantially less than the thickness of the workpiece yet is sufficient to provide clearance between the end of the punch 70 and the out of alignment opening 100 when the punch is at the bottom of its stroke with respect to the die assembly.

Figure 9:
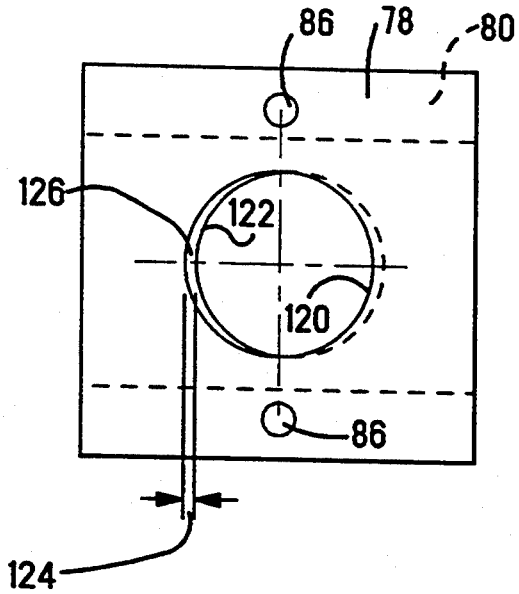
FIG. 9 is a view similar to that of FIG. 7 showing a circular die opening.

While tooling that produced a rectangular slug 110 was used to illustrate the teachings of the present invention, these teachings may be advantageously utilized with other shapes as well. The only requirement is that the amount of out of alignment 102 that is produced by the rotation of the opening 100 not exceed the amount of clearance 85 between the punch and die assembly by more than about 20 percent, and preferably should be about the same. The out of alignment may also be provided by a lateral displacement of the opening 100 instead of a rotational displacement or, by both lateral and rotational displacements, as long as the amount of out of alignment 102 is limited as outlined above. While this linear displacement is suitable for rectangular and other shaped slugs, it is necessary in the case of circular slugs, for obvious reasons. Such a case is illustrated in FIG. 9, which is a view similar to that of FIG. 7 except showing a circular opening 120 in the die insert 78 and a corresponding circular opening 122 in the die insert support 80. The circular opening 122 is displaced from the opening 120 to the right, as viewed in FIG. 9, an amount 124 that is substantially equal to the amount of displacement 102 shown in FIG. 7, and includes a chamfer 126 along its upper edge similar to the chamfer 105. When the punch 70 blanks out such a circular slug and forces it into the displaced opening 122 thereby shifting the slug to the right, the slug becomes trapped under the bottom surface of the die insert 78 and is stripped off of the end of the punch when the punch is withdrawn from the opening 120, in a manner similar to that of the rectangular slug 110. As with the rotation of the slug, shifting of the slug weakens the holding force caused by surface tension of any oil film that is between the end of the punch and the slug and aids in its separation. In the case of slugs having unusual shapes, such as keyhole shapes, the punch may benefit by both a lateral displacement and a rotational displacement to direct the forces, created by the camming action of the slug being forced against the chamfer 105, toward the stronger portions of the punch.

An important advantage of the present invention is the complete elimination of slug pulling and the accompanying potential for damaged products and tooling and, even more importantly, the avoidance of equipment down time. This results in higher product reliability, increased productivity, and reduced maintenance costs.

We claim:

1. A stamping and forming machine having a stamping and forming module for performing stamping and forming operations on strip stock, said module including a frame, a drive shaft journaled for rotation in said frame, first and second ram assemblies which are reciprocative toward and away from each other along a horizontal path between forward and retracted positions, first and second actuator levers for reciprocating the ram assemblies, each lever being coupled to a respective said ram assembly, having a fixed pivot relative to said frame of said module, and being coupled to said drive shaft for effecting reciprocation of said respective ram assembly, a punch and mating die coupled to said first and second ram assemblies, respectively, for reciprocation toward and away from each other along said horizontal path for blanking an opening of desired shape in a workpiece having a thickness, said punch and mating die comprising:

(a) said punch having an outer mating surface of desired shape;

(b) a die insert having a first opening of said desired shape in alignment with said punch for mating therewith;

(c) a die insert support arranged in abutting support against a side of said die insert opposite said punch for supporting said die insert during a blanking operation and having a second opening substantially identical to said first opening and positioned slightly out of alignment therewith, so that when said punch or die reciprocate into engagement with the other of said punch or die, a slug is blanked out of said workpiece and moved through said first opening and forced out of alignment with said first opening and into said second opening.

2. The machine according to claim 1 wherein said out of alignment is a lateral displacement of said second opening with respect to said first opening.

3. The machine according to claim 2 wherein said out of alignment of said second opening with respect to said first opening has a point of maximum out of alignment that is less than about one half said thickness of said workpiece.

4. The machine according to claim 1 wherein said out of alignment is a rotational displacement of said second opening with respect to said first opening.

5. The machine according to claim 4 wherein each of said first and second openings has an axis, and wherein said axes are coincident.

6. The machine according to claim 5 wherein said out of alignment of said second opening with respect to said first opening has a point of maximum out of alignment that is equal to less than about one half said thickness of said workpiece.

7. The machine according to claim 6 wherein said out of alignment is equal to between about 2 percent and about 15 percent of said thickness of said workpiece.

8. The machine according to claim 7 wherein said out of alignment is equal to between about 6 percent and about 8 percent of said thickness of said workpiece.

9. The machine according to claim 7 wherein said second opening has a lead-in chamfer adjacent said first opening.

10. The machine according to claim 1 wherein said first opening is spaced from said second opening an amount equal to about one half said thickness of said workpiece.

11. The machine according to claim 1 wherein said die insert support includes a recess in its surface abutting said die insert that surrounds and extends to the edges of said second opening, said recess having a depth equal to about one half said thickness of said workpiece.

12. The machine according to claim 1 including a die plate with a hole for receiving and accurately positioning said die insert with respect to said punch, wherein said die insert is secured to said die insert support and said die insert support includes a heel thereon extending into an undercut formed in said die plate adjacent said hole to hold said die insert support within said hole in said die plate.

13. A punch and mating die, one of which is arranged to reciprocate toward and away from the other for blanking an opening of desired shape in a workpiece having a thickness positioned therebetween comprising:

(a) a punch having an outer mating surface of desired shape;

(b) a die insert having a first opening of said desired shape in alignment with said punch for mating therewith, said first opening being sized to receive said punch therein;

(c) a die insert support arranged in abutting support against a side of said die insert opposite said punch for supporting said die insert during a blanking operation and having a second opening substantially identical to said first opening and positioned slightly out of alignment therewith, so that when said punch or die reciprocate into engagement with the other, a slug is blanked out of said workpiece and moved through said first opening and forced out of alignment with said first opening and into said second opening.

14. The punch and mating die according to claim 13 wherein said out of alignment is a lateral displacement of said second opening with respect to said first opening.

15. The punch and mating die according to claim 14 wherein said out of alignment of said second opening with respect to said first opening has a point of maximum out of alignment that is about equal to one half said thickness of said workpiece.

16. The punch and mating die according to claim 13 wherein said out of alignment is a rotational displacement of said second opening with respect to said first opening.

17. The punch and mating die according to claim 16 wherein each of said first and second openings has an axis, and wherein said axes are coincident.

18. The punch and mating die according to claim 17 wherein said out of alignment of said second opening with respect to said first opening has a point of maximum out of alignment that is equal to less than about one half said thickness of said workpiece.

19. The punch and mating die according to claim 18 wherein said out of alignment is equal to between about 2 percent and about 15 percent of said thickness of said workpiece.

20. The punch and mating die according to claim 19 wherein said out of alignment is equal to between about 6 percent and about 8 percent of said thickness of said workpiece.

21. The punch and mating die according to claim 20 wherein said second opening has a lead-in chamfer adjacent said first opening.

22. The punch and mating die according to claim 13 wherein said first opening is spaced from said second opening an amount equal to about one half said thickness of said workpiece.

23. The punch and mating die according to claim 13 wherein said die insert support includes a recess in its surface abutting said die insert that surrounds and extends to the edges of said second opening, said recess having a depth equal to about one half said thickness of said workpiece.

24. A mating punch and die wherein said die includes an opening for receiving said punch, said opening having a first portion in axial alignment with said punch and a second portion substantially identical in size and shape to said first portion and slightly out of axial alignment with said punch so that when said punch and die are moved into mated engagement with a workpiece therebetween, a slug is blanked out of said workpiece and moved through said first portion of said opening and forced out of alignment with said first portion and into said second portion of said opening.

* * * * *